US005683955A

United States Patent [19]

Hiroi et al.

[11] Patent Number: 5,683,955

[45] Date of Patent: Nov. 4, 1997

[54] THERMAL TRANSFER SHEET

[75] Inventors: Junichi Hiroi; Haruo Takeuchi, both of Tokyo-To, Japan

[73] Assignee: Dai Nippon Printing Co., Ltd., Japan

[21] Appl. No.: 540,403

[22] Filed: Oct. 6, 1995

[30] Foreign Application Priority Data

Oct. 7, 1994 [JP] Japan ..... 6-268035

[51] Int. Cl.[6] ..... B41M 5/035; B41M 5/38

[52] U.S. Cl. ..... 503/227; 428/195; 428/423.1; 428/488.4; 428/913; 428/914

[58] Field of Search ..... 428/195, 423.1, 428/484, 488.1, 488.4, 913, 914; 503/227; 8/471; 427/152

[56] References Cited

U.S. PATENT DOCUMENTS

| | | | |
|---|---|---|---|
| 4,735,860 | 4/1988 | Mizobuchi et al. | 428/447 |
| 5,185,314 | 2/1993 | Fujimura et al. | 503/227 |
| 5,494,884 | 2/1996 | Kobayashi et al. | 503/227 |

FOREIGN PATENT DOCUMENTS

| | | | |
|---|---|---|---|
| 0 280 763 | 9/1988 | European Pat. Off. | 428/488.4 |
| 0 589 442 | 3/1994 | European Pat. Off. | 428/488.4 |

OTHER PUBLICATIONS

Patent Abstracts Of Japan, vol. 16, No. 169, Apr. 23, 1992 & JP 04 014489 (Ricoh Co. Ltd) Jan. 20, 1992.

Database WPI, Section Ch, Week 9424, Derwent Publications Ltd., London, GB; Class A14, AN 94-196779 XP002005301 & JP-A-06 135 166 (Dai Nippon Printing Co. Ltd) May 17, 1994.

*Primary Examiner*—Bruce H. Hess

*Attorney, Agent, or Firm*—Parkhurst, Wendel & Burr, L.L.P.

[57] ABSTRACT

A thermal transfer sheet including: a substrate film, a heat-transferable colorant layer provided on one side of the substrate film, and a heat-resistant slip layer, provided on the other side of the substrate film. The slip layer includes a binder resin and a reaction product between a polyisocyanate and a straight-chain aliphatic hydrocarbon with 8 or more carbon atoms having, at its one end, a group reactive with an isocyanate group.

10 Claims, No Drawings

THERMAL TRANSFER SHEET

BACKGROUND OF THE INVENTION

1. Field of the Invention

This invention relates to a thermal transfer sheet and more particularly to a thermal transfer sheet which has an excellent heat-resistant slip layer formed of a specific material, exhibits high slipperiness on and releasability from a thermal head, neither causes collection of sheet debris on a thermal head of a printer nor cockles during printing, and can provide a high-quality image.

2. Background Art

As thermal transfer sheets, there are known in the art a sublimation thermal transfer sheet comprising, as a substrate film, a plastic film, such as a polyester film, and a dye layer, provided on one side of the substrate film, formed of a sublimable dye and a binder resin and a hot-melt thermal transfer sheet having the same layer construction as the sublimation thermal transfer sheet except for the provision of an ink layer, formed of a hot-melt composition containing a colorant, instead of the dye layer. These thermal transfer sheets are heated imagewise from the back side thereof by means of a thermal head to transfer the dye in the dye layer or the ink layer onto an image-receiving material, thereby forming an image.

The conventional thermal transfer sheets which use a plastic film as the substrate film, which is meltable upon contact with a thermal head, pose problems during the formation of an image, such as sticking of the substrate film to the thermal head and breaking of the substrate film. One proposed method for solving these problems is to provide a heat-resistant slip layer formed of a modified resin, such as a thermosetting resin or a silicone resin, or a combination of the modified resin with various crosslinking agents, on the side of the substrate film remote from the colorant layer.

An increase in printing speed of printers and an improvement in image quality have resulted in a demand for further improved heat resistance and slip property of the heat-resistant slip layer. This has led to a proposal of the incorporation of a lubricant having a slip property and releasability, such as a surfactant, an oil, an organometal salt, or wax, into the heat-resistant slip layer.

In the formation of an image by means Of a thermal head using a thermal transfer sheet, when energy corresponding to each print density is applied to the thermal transfer sheet, stable slipperiness on and releasability from the thermal head over the whole energy range are required of the thermal transfer sheet.

However, when the lubricant added is a liquid, the miscibility with a binder resin constituting the heat-resistant slip layer is poor. In particular, when the lubricant is a low-viscosity liquid, the lubricant migrates towards the opposite side of the substrate film or a carrying roll during the production or fabrication process, making it impossible to ensure the lubricant in a sufficient amount in the slip layer of the thermal transfer sheet as a final product. This results in problems such as a lowered slip property and, when the thermal transfer sheet is rolled into a small roll form, the migration of a dye of the colorant layer facing the heat-resistant slip layer to the heat-resistant slip layer, causing the contamination of the heat-resistant slip layer with the dye.

When the lubricant is a solid powder or wax, the response to instantaneous heating by a thermal head is so poor that the slip property or releasability is unsatisfactory. Further, the lubricant deposits as sheet debris on the thermal head, adversely affecting the printing.

Further, in the formation of an image, when an image area and a non-image area are present on the same line, a difference in quantity of heat applied by a thermal head between the image area and the non-image area causes a difference in slipperiness (coefficient of friction) between the image area and the non-image area, resulting in the occurrence of cockle in the thermal transfer sheet during printing.

Accordingly, an object of the present invention is to provide a thermal transfer sheet which possesses excellent slipperiness on and releasability from a thermal head, neither causes collection of sheet debris on a thermal head nor cockles during printing, and can provide a high-quality image.

SUMMARY OF THE INVENTION

The above object can be attained, according to the present invention, by a thermal transfer sheet comprising a substrate film, a heat-transferable colorant layer on one side of the substrate film, and a heat-resistant slip layer, provided on the other side of the substrate film, comprising a binder resin and a reaction product between a polyisocyanate and a straight-chain aliphatic hydrocarbon with 8 or more carbon atoms having, at its one end, a group reactive with an isocyanate group.

The use of the specific material as a lubricant, which has good miscibility with a binder resin and is less likely to cause migration, in a heat-resistant slip layer of a thermal transfer sheet, can provide a thermal transfer sheet which has excellent releasability from and slipperiness on a thermal head of a printer, neither causes collection of sheet debris on a thermal head nor cockles in the course of printing, and can provide a high-quality image.

DETAILED DESCRIPTION OF THE INVENTION

The present invention will now be described in more detail with reference to the following preferred embodiments.

A material for the substrate sheet constituting the thermal transfer sheet of the present invention is not particularly limited and may be any conventional one so far as it has satisfactory heat resistance and strength. Examples of the substrate sheet include 0.5 to 50 μm-thick, preferably 3 to 10 μm-thick films of resins, for example, polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohol, cellophane, cellulose derivatives, such as cellulose acetate, polyethylene, polyvinyl chloride, nylon, polyimide, and ionomers. In addition, it may be formed of paper, such as capacitor paper or paraffin paper, nonwoven fabric, or a composite of paper or nonwoven fabric and a resin.

The heat-resistant slip layer provided on one side of the substrate film comprises a binder resin and a lubricant comprising a reaction product between a polyisocyanate and a straight-chain aliphatic hydrocarbon with 8 or more carbon atoms having, at its one end, a group reactive with an isocyanate group.

The binder resin used for the formation of the heat-resistant slip layer is not particularly limited, and a thermoplastic resin and a thermosetting resin, either alone or in combination, may be used, when the resin has a reactive group, a product of a reaction thereof with various isocyanate curing agents or a product of a reaction thereof with a monomer or an oligomer having an unsaturated bond may also be used. Curing may be carried out by any method without limitation, such as heating or irradiation with an ionizing radiation, such as electron beam or ultraviolet light. Further, it is also possible to use various modified resins prepared by modifying binder resins with silicone or long-chain alkyls.

Preferred binder resins include polyester resins, polyacrylic ester resins, polyvinyl acetate resins, styrene acrylate resins, polyurethane resins, polyolefin resins, polystyrene resins, polyvinyl chloride resins, polyether resins, polyamide resins, polycarbonate resins, polyethylene resins, polypropylene resins, polyacrylate resins, polyacrylamide resins, polyvinyl chloride resins, polyvinyl butyral resins, and polyvinyl acetoacetal resins. Among them, polyvinyl acetal resins, such as polyvinyl butyral resins and polyacetoacetal resins, are particularly preferred.

The modified resin includes resins prepared by reacting commercially available various modified silicone resins or resins having a hydroxyl group, such as acrylic polyols or acetal resins, with a monohydric higher alcohol modified with an isocyanate.

According to a preferred embodiment of the present invention, a polyisocyanate is preferably used as a crosslinking agent for a binder resin in order to impart good heat resistance, coating properties, and adhesion to the substrate film to the heat-resistant slip layer. The polyisocyanate may be any polyisocyanate which is commonly used in the synthesis of conventional paints, adhesives, or polyurethane.

Commercially available polyisocyanate compounds usable in the present invention include, for example, Takenate (manufactured by Takeda Chemical Industries, Ltd.), Burhock (manufactured by Dainippon Ink and Chemicals, Inc.), Coronate (manufactured by Nippon Polyurethane Industry Co., Ltd.), Duranate (manufactured by Asahi Chemical Industry Co., Ltd.), and Desmodur (manufactured by Bayer).

The amount of the polyisocyanate added is suitably in the range of from 5 to 280 parts by weight based on 100 parts by weight of the binder resin constituting the heat-resistant slip layer. The NCO to OH ratio is preferably in the range of from 0.6:1 to 2.0:1. When the amount of the polyisocyanate used is insufficient, the crosslinking density becomes so low that the heat resistance is deteriorated. On the other hand, when it is excessively large, the shrinkage of the coating formed cannot be controlled, requiring a prolonged curing time. Further, when an unreacted NCO group is left in the heat-resistant slip layer, it unfavorably reacts with moisture in the air or reacts with a binder resin or a dye in the transferable colorant layer.

Instead of or in addition to the polyisocyanate as the crosslinking agent, a monomer or an oligomer having an unsaturated bond may be used from the viewpoint of imparting good heat resistance, coating properties, and adhesion to the substrate film to the heat-resistant slip layer. When the monomer or oligomer having an unsaturated bond is used as the crosslinking agent, curing may be carried out by either electron beam irradiation or UV irradiation. When the amount of the filler added is large, curing by electron beam irradiation is preferred. Examples of the monomer or oligomer having an unsaturated bond include difunctional monomers such as tetraethylene glycol di(meth)acrylate [(meth) acrylate refers to both acrylate and methacrylate; the same shall apply hereinafter], divinylbenzene, and diallyl phthalate; trifunctional monomers such as triallyl isocyanurate and trimethylolpropane tri(meth)acrylate; tetramethylolmethane tetra(meth)acrylate; trimethoxyethoxyvinylsilane; penta- or higher functional monomers; and oligomers or macromers of above monomers.

The lubricant used in the present invention is a reaction product between a polyisocyanate and a straight-chain aliphatic hydrocarbon with 8 or more carbon atoms having, at its one end, a group reactive with an isocyanate group. Groups reactive with the isocyanate group include hydroxyl, amino, carboxyl, and mercapto groups. Among them, hydroxyl and amino groups are preferred with a hydroxyl group being particularly preferred.

Specifically, one example of the straight-chain aliphatic hydrocarbon with 8 or more carbon atoms is a monohydric higher alcohol, and more specific examples thereof include aliphatic saturated alcohols such as octyl, capryl, nonyl, decyl, undecyl, lauryl, tridecyl, myristyl, pentadecyl, cetyl, heptadecyl, stearyl, nonadecyl, eicosyl, ceryl, and melissyl alcohols.

Another example of the straight-chain aliphatic hydrocarbon with 8 or more carbon atoms is an aliphatic primary amine, and more specific examples thereof include aliphatic saturated higher amines such as octyl, nonyl, decyl, undecyl, lauryl, tridecyl, tetradecyl, pentadecyl, cetyl, heptadecyl, and stearyl amines.

In the present invention, the polyisocyanate compound used in combination with the straight-chain aliphatic hydrocarbon is a compound having two or more isocyanate groups. Any polyisocyanate compound commonly used in conventional techniques associated with polyurethane resins may be used for this purpose, and examples thereof include TDI (toluene diisocyanate), HDI (diphenyl methane diisocyanate), NDI (1,5-naphthalene diisocyanate), TODI (tolidine diisocyanate), NDI (hexamethylene diisocyanate, IPDI (isophorone diisocyanate), p-phenylene diisocyanate, XDI (xylylene diisocyanate), hydrogenated HDI, hydrogenated MDI, LDI (lysine diisocyanate), TMXDI (tetramethylxylene diisocyanate), lysine ester triisocyanate, 1,6,11-undecane triisocyanate, 1,8-diisocyanate-4-isocyanate methyl octane, 1,3,6-hexamethylene triisocyanate, bicycloheptane triisocyanate, and TMDI (trimethyl hexamethylene diisocyanate). The polyisocyanate compound is not limited to the above compounds, and other compounds may also be used so far as they have an isocyanate group. Among the above polyisocyanates, aromatic polyisocyanates are preferred for the purpose of the present invention.

The monohydric higher alcohol and/or amine is reacted with the polyisocyanate according to a conventional method for synthesizing a urethane. If necessary, the reaction may be carried out in the presence of a catalyst such as an organometal or an amine. Preferably, the reaction of the monohydric higher alcohol and/or amine with the polyisocyanate is carried out in an NCO to OH($NH_2$) ratio of about 0.8:1 to 1.4:1. The appearance and properties of the reaction product vary depending upon a combination of the higher alcohol and/or amine with the polyisocyanate and the reaction ratio of these components. A combination of a higher alcohol and/or amine, such as lauryl, cetyl, or stearyl alcohol and/or amine, with a general-purpose polyisocyanate, such as TDI, MDI, or HDI, is preferred. Particularly preferred is a reaction product having an OH(NH) to NCO ratio of about 1:1.

The incorporation of at least one of the above reaction products into the heat-resistant slip layer enables satisfactory slip property and releasability to be imparted to the heat-resistant slip layer. The amount of the reaction product added as a lubricant is 1 to 100 parts by weight, preferably 2 to 50 parts by weight, based on 100 parts by weight of the binder resin for forming the heat-resistant slip layer. When the amount of the lubricant added is excessively small, the releasability of the thermal transfer sheet from the thermal head is unsatisfactory, which is causative of the occurrence of cockle during printing, collection of sheet debris on the thermal head, and sticking. On the other hand, when the amount of the lubricant added is excessively large, the lubricant after heating by means of a thermal head followed by cooling, in some cases, is collected and deposited as sheet debris on the thermal head.

Further, in the present invention, the addition of a higher fatty acid metal salt in addition to the reaction product between a straight-chain aliphatic hydrocarbon and an isocyanate results in further improved slipperiness of the heat-resistant slip layer on the thermal head and releasability of the heat-resistant slip layer from the thermal head. The metal salt is preferably a lithium, magnesium, or calcium salt of a higher fatty acid. Specific examples of the higher fatty acid metal salt include calcium stearate, magnesium stearate, lithium stearate, calcium laurate, magnesium laurate, and lithium laurate.

The amount of the higher fatty acid metal salt added is preferably 20 to 80 parts by weight based on 100 parts by weight of the reaction product between a straight-chain aliphatic hydrocarbon and an isocyanate.

In some cases, other lubricants may be used in combination with the above lubricant from the viewpoint of further improving the performance and stabilizing the performance. Examples of the additional lubricant include waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, and long-chain aliphatic compounds. More specific examples thereof include phosphate ester surfactants, dimethypolysiloxane, methylphenytpolysiloxane, fatty acid amides, fatty acid esters, long-chain aliphatic compounds, low-molecular weight polypropylene, a copolymer of ethylene oxide with propylene oxide, a condensate of a fatty acid salt with a polyether compound, perfluoroalkyl ethylene oxide adducts, nonionic surfactants, such as sorbitan acid esters, and sodium long-chain alkylsulfonates. The amount of these additional lubricants used may be 5 to 100 parts by weight, preferably 5 to 50 parts by weight, based on 100 parts by weight of the reaction product.

Further, according to the present invention, an inorganic or organic filler is preferably used in order to impart fabricability of the thermal transfer sheet, stable carriability of the thermal transfer sheet during printing, and capability of the thermal transfer sheet to clean the thermal head. The filler selected should have particle diameter and shape sufficient to form irregularities on the surface of the heat-resistant slip layer and, at the same time, is less likely to abrade the thermal head. Suitable fillers include, for example, inorganic fillers, such as talc, kaolin, clay, calcium carbonate, magnesium hydroxide, magnesium carbonate, precipitated barium sulfate, and hydrotalcite, and organic fillers, such as acrylic resin, benzoguanamine resins, silicone, and teflon. Preferred are talc, kaolin, clay and the like which are cleavable and, at the same time, can clean the thermal head although the hardness is relatively low. Specifically, in the case of the talc, the hardness is preferably 5 to 200 mg in terms of shot-type abrasion loss. When the abrasion loss is low, the particles are so soft that they are collapsed by heat or pressure applied during printing and likely to cause collection of sheet debris on a thermal head. On the other hand, when the abrasion loss is excessively high, the abrasion of the protective layer in the thermal head becomes significant.

The heat-resistant slip layer may be formed by dissolving or dispersing the above ingredients in a solvent, such as acetone, methyl ethyl ketone, toluene, or xylene, or water, selected so as to provide desired coatability, thereby preparing a coating composition, coating the coating composition by conventional coating means, such as a gravure coater, a roll coater, or a wire bar, and drying and solidifying the coating to form a heat-resistant slip layer. The coverage, i.e., the thickness, of the heat-resistant slip layer is preferably not more than 3.0 g/m$^2$, still preferably 0.1 to 1.0 g/m$^2$. This thickness suffices for a heat-resistant slip layer having satisfactory properties. When a coating composition, for a heat-resistant slip layer, containing a polyisocyanate as a crosslinking agent is used, an unreacted isocyanate group remains, in many cases, in the layer after coating and drying. In this case, heat aging is preferably carried out in order to complete the reaction.

The heat-transferable colorant layer formed on the opposite side of the substrate sheet may be prepared by forming a layer containing a subtimable dye when the thermal transfer sheet is of a sublimation type or by forming a hot-melt layer using a hot-melt ink colored with a pigment or the like when the thermal transfer sheet is of a hot-melt type.

The dye sublimation thermal transfer sheet will now be described in detail as a representative example, though the present invention is not limited to the dye sublimation thermal transfer sheet. The dye in the sublimation-type heat-transferable colorant layer is not particularly limited, and any conventional dye used in the thermal transfer sheet can be used in the present invention. Preferred examples of red dyes include MS Red G., Marcrolex Red Violet R, Ceres Red 7B, Samaron Red HBSL., and Resolin Red P3BS. Preferred examples of yellow dyes include Foron Brilliant Yellow 6GL and PTY-52 and Macrolex Yellow 6G., and preferred examples of blue dyes include Kayaset Blue 714, Waxoline Blue AP-FW, Foron Brilliant Blue S-R, and MS Blue 100.

Preferred examples of binder resins for holding the above dyes include cellulosic resins such as ethyl cellulose, hydroxyethyl cellulose, ethylhydroxycellulose, hydroxypropyl cellulose, methyl cellulose, cellulose acetate, and cellulose acetate butyrate: vinyl resins such as polyvinyl alcohol, polyvinyl acetate, polyvinyl butyral, polyvinyl acetoacetal, and polyvinylpyrrolidone; acrylic resins such as poly(meth) acrylate, and poly(meth)acrylamide; polyurethane resins; polyamide resins; and polyester resins. Among them, cellulosic, vinyl, acrylic, polyurethane, polyester and other resins are preferred from the viewpoint of heat resistance, transferability of dyes and the like.

The dye layer maybe formed by coating one side of the above substrate sheet with a suitable organic solvent solution or an organic solvent (such as toluene, methyl ethyl ketone, ethanol, isopropyl alcohol, cyclohexanone, or DMF) or water dispersion of the above dye and binder and optional additives, for example, a release agent or inorganic fine particles, for example, by gravure printing, screen printing, reverse roll coating where a gravure plate is used, or the like and drying the coating.

The thickness of the dye layer is generally 0.2 to 5.0 μm, preferably about 0.4 to 2.0 μm, and the content of the sublimable dye in the dye layer is suitably 5 to 90% by weight, preferably 10 to 70% by weight, based on the weight of the dye layer.

When the formation of a monochrome image from the dye layer is contemplated, one dye selected from the above dyes is used to form the dye layer. On the other hand, when the formation of a full-color image from the dye layer is contemplated, suitable cyan, magenta, and yellow (and, if necessary, black) dyes are selected and used to form cyan, magenta, and yellow (and, if necessary, black) dye layers.

An image-receiving sheet is used to form an image utilizing the thermal transfer sheet. The image-receiving sheet may be any sheet so far as it has receptivity to the above dyes. When the use of paper, metals, glass, synthetic resins and the like, which are unreceptive to dyes, is contemplated, a dye-receptive layer may be formed on at least one side of these materials. When the thermal transfer sheet is of a hot-melt type, the receiving material is not particularly limited and may be any conventional paper and plastic films.

A printer used in thermal transfer using the above thermal transfer sheet and the above image-receiving sheet is not particularly limited, and conventional thermal printers, as such, may be usable.

The following reference examples, examples, and comparative examples further illustrate the present invention but are not intended to limit it. In the following reference examples, examples, and comparative examples, all "parts" or "%" are by weight unless otherwise specified.

REFERENCE EXAMPLE 1

50 parts of 2,4TDI (Desmodur T100, manufactured by Nippon Polyurethane Co., Ltd.) was dissolved in 150 parts of a solvent of a 1:1 mixture of ethyl acetate and toluene. A solution prepared by heat-dissolving 15.1 parts of stearyl alcohol in 45.3 parts of a solvent of a 1:1 mixture of ethyl acetate and toluene at 60° C. was added dropwise to the solution, and a reaction was allowed to proceed at 80° C. for 5 hours to give a reaction product solution having a solid content of 25%.

REFERENCE EXAMPLE 2

50 parts of a mixture of 2,4TDI with 2,6TDI (Desmodur T65, manufactured by Nippon Polyurethane Co., Ltd.) was dissolved in 150 parts of a solvent of a 1:1 mixture of ethyl acetate and toluene. A solution prepared by heat-dissolving 15.1 parts of stearyl alcohol in 45.3 parts of a solvent of a 1:1 mixture of ethyl acetate and toluene at 60° C. was added dropwise to the solution, and a reaction was allowed to proceed at 80° C. for 5 hours to give a reaction product solution having a solid content of 25%.

REFERENCE EXAMPLE 3

50 parts of 2,4TDI (Desmodur T100, manufactured by Nippon Polyurethane Co., Ltd.) was dissolved in 150 parts of a solvent of a 1:1 mixture of ethyl acetate and toluene. A solution prepared by heat-dissolving 7.5 parts of stearyl alcohol and 5.1 parts of lauryl alcohol in 48 parts of a solvent of a 1:1 mixture of ethyl acetate and toluene at 60° C. was added dropwise to the solution, and a reaction was allowed to proceed at 80° C. for 5 hours to give a reaction product solution having a solid content of 25%.

REFERENCE EXAMPLE 4

50 parts of HDI (Duranate 50M) was dissolved in 150 parts of a solvent of a 1:1 mixture of ethyl acetate and toluene. A solution prepared by heat-dissolving 15.1 parts of stearyl alcohol in 45.3 parts of a solvent of a 1:1 mixture of ethyl acetate and toluene at 60° C. was added dropwise to the solution, and a reaction was allowed to proceed at 80° C. for 5 hours to give a reaction product solution having a solid content of 25%.

REFERENCE EXAMPLE 5

50 parts of 2,4TDI (Desmodur T100, manufactured by Nippon Polyurethane Co., Ltd.) was dissolved in 150 parts of a solvent of a 1:1 mixture of ethyl acetate and toluene. A solution prepared by dissolving 4.1 parts of butanol in 45.3 parts of a solvent of a 1:1 mixture of ethyl acetate and toluene was added dropwise to the solution, and a reaction was allowed to proceed at 80° C. for 5 hours to give a reaction product solution having a solid content of 25%.

REFERENCE EXAMPLE 6

50 parts of HDI (Duranate 50M) was dissolved in 150 parts of a solvent of a 1:1 mixture of ethyl acetate and toluene. A solution prepared by heat-dissolving 5.7 parts of n-hexyl alcohol in 17.1 parts of a solvent of a 1:1 mixture of ethyl acetate and toluene at 60° C. was added dropwise to the solution, and a reaction was allowed to proceed at 80° C. for 5 hours to give a reaction product solution having a solid content of 25%.

REFERENCE EXAMPLE 7

50 parts of 2,4TDI (Desmodur T100, manufactured by Nippon Polyurethane Co., Ltd.) was dissolved in 150 parts of a solvent of a 1:1 mixture of ethyl acetate and toluene. A solution prepared by heat-dissolving 15 parts of stearylamine in 45.3 parts of toluene at 80° C. was added dropwise to the solution, and a reaction was allowed to proceed at 80° C. for 5 hours to give a reaction product solution having a solid content of 25%.

REFERENCE EXAMPLE 8

50 parts of a mixture of 2,4TDI with 2,6TDI (Desmodur T65, manufactured by Nippon Polyurethane Co., Ltd.) was dissolved in 150 parts of a solvent of a 1:1 mixture of ethyl acetate and toluene. A solution prepared by heat-dissolving 15 parts of stearylamine in 45.3 parts of toluene at 80° C. was added dropwise to the solution, and a reaction was allowed to proceed at 80° C. for 5 hours to give a reaction product solution having a solid content of 25%.

REFERENCE EXAMPLE 9

50 parts of 2,4TDI (Desmodur T100, manufactured by Nippon Polyurethane Co., Ltd.) was dissolved in 150 parts of a solvent of a 1:1 mixture of ethyl acetate and toluene. A solution prepared by heat-dissolving 7.5 parts of stearylamine and 5.1 parts of laurylamine in 48 parts of toluene at 80° C. was added dropwise to the solution, and a reaction was allowed to proceed at 80° C. for 5 hours to give a reaction product solution having a solid content of 25%.

REFERENCE EXAMPLE 10

50 parts of HDI (Durandre 50M) was dissolved in 150 parts of a solvent of a 1:1 mixture of ethyl acetate and toluene. A solution prepared by heat-dissolving 15 parts of stearylamine in 45.3 parts of toluene at 80° C. was added dropwise to the solution, and a reaction was allowed to proceed at 80° C. for 5 hours to give a reaction product solution having a solid content of 25%.

REFERENCE EXAMPLE 11

50 parts of 2,4TDI (Desmodur T100, manufactured by Nippon Polyurethane Co., Ltd.) was dissolved in 150 parts of a solvent of a 1:1 mixture of ethyl acetate end toluene. A solution prepared by dissolving 4.1 parts of butylamine in 45.3 parts of toluene was added dropwise to the solution, and a reaction was allowed to proceed at 80° C. for 5 hours to give a reaction product solution having a solid content of 25%.

REFERENCE EXAMPLE 12

50 parts of HDI (Duranate 50M) was dissolved in 150 parts of a solvent of a 1:1 mixture of ethyl acetate and toluene. A solution prepared by heat-dissolving 5.7 parts of n-hexylamine in 17.1 parts of toluene at 60° C. was added dropwise to the solution, and a reaction was allowed to proceed at 80° C. for 5 hours to give a reaction product solution having a solid content of 25%.

EXAMPLE 1

The following coating composition A for a heat-resistant slip layer was coated on a 4.5 μm-thick polyester film as a substrate film to a thickness on a dry basis of 1.0 g/m$^2$, and the resultant coating was dried to form a heat-resistant slip layer.

| Coating composition A | |
|---|---|
| polyvinyl butyral (S-lec BX-1, manufactured by Sekisui Chemical Co., Ltd.) | 3.6 parts |
| Solution of Reference Example 1 | 7.2 parts |
| Talc (Microace P-3, manufactured by Nippon Talc Co., Ltd.) | 0.2 part |
| Toluene | 11.0 parts |
| Ethyl acetate | 11.0 parts |

The following ink composition was gravure-coated on the back side of the substrate film remote from the heat-resistant slip layer at a coverage on a dry basis of 1.0 g/m$^2$, and the coating was dried under conditions of drying temperature 100° to 110° C. and residence time in a drying hood 30 sec to form a dye layer, thereby preparing a thermal transfer sheet of the present invention.

| Ink composition for dye layer | |
|---|---|
| C. I solvent Blue 22 | 5.5 parts |
| Polyvinyl acetoacetal resin (KS-5, manufactured by Sekisui Chemical Co., Ltd.) | 3.0 parts |
| Methyl ethyl ketone | 22.0 parts |
| Toluene | 68.0 parts |

EXAMPLE 2

A thermal transfer sheet of the present invention was prepared in the see manner as in Example 1, except that, instead of the coating composition, for a heat-resistant slip layer, used in Example 1, the following coating composition B was coated and the resultant coating was dried and then heat-aged, thereby curing the coating.

| Coating composition B | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Solution of Reference Example 1 | 11.5 parts |
| Phosphate ester surfactant (Phosphanol RD720, manufactured by Toho Chemical Industry Co., Ltd.) | 0.3 part |
| Kaolin (Kaolinite ASP-072, manufactured by Tsuchiya Kaolin Co., Ltd.) | 0.2 part |
| Methyl ethyl ketone | 28.0 parts |
| Toluene | 28.0 parts |

EXAMPLE 3

A thermal transfer sheet of the present invention was prepared in the same manner as in Example 1, except that, instead of the coating composition, for a heat-resistant slip layer, used in Example 1, the following coating composition C was coated and the resultant coating was dried and irradiated with an electron beam under conditions of accelerated voltage 175 keV and 3 Mrad, thereby curing the coating by crosslinking.

| Coating composition C | |
|---|---|
| Polyvinyl butyral resin (S-lec BX-1, manufactured by Sekisui Chemical Co., Ltd.) | 3.6 parts |
| Polyfunctional monomer (kayarad DPHA, manufactured by Nippon Kayaku Co., Ltd.) | 0.7 part |
| Solution of Reference Example 2 | 3.2 parts |
| Nonionic surfactant (Nonion-OP85R, manufactured by Nippon Oils & Fats Co., Ltd.) | 0.3 part |
| Clay (ASP-200, manufactured by Tsuchiya Kaolin Co., Ltd.) | 0.2 part |
| Toluene | 12.0 parts |
| Ethyl acetate | 12.0 parts |

EXAMPLE 4

A thermal transfer sheet of the present invention was prepared in the same manner as in Example 1, except that the following coating composition D was used instead of the coating composition, for a heat-resistant slip layer, used in Example 1.

| Coating composition D | |
|---|---|
| Polyvinyl butyral resin (S-lec BX-1, manufactured by Sekisui Chemical Co., Ltd.) | 3.6 parts |
| Solution of Reference Example 2 | 2.8 parts |
| Talc (Microace P-3, manufactured by Nippon Talc Co., Ltd.) | 0.2 part |
| Toluene | 10.0 parts |
| Ethyl acetate | 10.0 parts |

EXAMPLE 5

A thermal transfer sheet of the present invention was prepared in the same manner as in Example 1, except that the following coating composition E was used instead of the coating composition, for a heat-resistant slip layer, used in Example 1.

| Coating composition E | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Solution of Reference Example 4 | 11.5 parts |
| Phosphate ester surfactant (Phosphanol RD720, manufactured by Toho Chemical Industry Co., Ltd.) | 0.3 part |
| Kaolin (Kaolinite ASP-072, manufactured by Tsuchiya Kaolin Co., Ltd.) | 0.2 part |
| Methyl ethyl ketone | 28.0 parts |
| Toluene | 28.0 parts |

EXAMPLE 6

A thermal transfer sheet of the present invention was prepared in the same manner as in Example 1, except that the following coating composition F was used instead of the coating composition, for a heat-resistant slip layer, used in Example 1.

| Coating composition F | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Solution of Reference Example 2 | 5.8 parts |
| Solution of Reference Example 3 | 5.8 parts |
| Phosphate ester surfactant (Phosphanol RD720, manufactured by Toho Chemical Industry Co., Ltd.) | 0.3 part |
| Kaolin (Kaolinite ASP-072, manufactured by Tsuchiya Kaolin Co., Ltd.) | 0.2 part |
| Methyl ethyl ketone | 28.0 parts |
| Toluene | 28.0 parts |

EXAMPLE 7

A thermal transfer sheet of the present invention was prepared in the same manner as in Example 1, except that the solution of Reference Example 7 was used instead of the solution of Reference Example 1.

EXAMPLE 8

A thermal transfer sheet of the present invention was prepared in the same manner as in Example 2, except that the solution of Reference Example 7 was used instead of the solution of Reference Example 1.

EXAMPLE 9

A thermal transfer sheet of the present invention was prepared in the same manner as in Example 3, except that the solution of Reference Example 8 was used instead of the solution of Reference Example 2.

EXAMPLE 10

A thermal transfer sheet of the present invention was prepared in the same manner as in Example 4, except that the solution of Reference Example 9 was used instead of the solution of Reference Example 3.

EXAMPLE 11

A thermal transfer sheet of the present invention was prepared in the same manner as in Example 5, except that the solution of Reference Example 10 was used instead of the solution of Reference Example 4.

EXAMPLE 12

A thermal transfer sheet of the present invention was prepared in the same manner as in Example 6, except that the solution of Reference Example 1 and the solution of Reference Example 7 were used instead of the solution of Reference Example 2 and the solution of Reference Example 3, respectively.

COMPARATIVE EXAMPLE 1

A comparative thermal transfer sheet was prepared in the same manner as in Example 1, except that, instead of the coating composition, for a heat-resistant slip layer, used in Example 1, the following coating composition G was coated and the resultant coating was dried and then heat-aged, thereby curing the coating.

| Coating composition G | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Solution of Reference Example 5 | 11.5 parts |
| Phosphate ester surfactant (Phosphanol RD720, manufactured by Toho Chemical Industry Co., Ltd. | 0.3 parts |
| Kaolin (Kaolinite ASP-072, manufactured by Tsuchiya Kaolin Co., Ltd.) | 0.2 part |
| Methyl ethyl ketone | 33.0 parts |
| Toluene | 33.0 parts |

COMPARATIVE EXAMPLE 2

A comparative thermal transfer sheet was prepared in the same manner as in Example 1, except that, instead of the coating composition, for a heat-resistant slip layer, used in Example 1, the following coating composition H was coated and the resultant coating was dried and then heat-aged, thereby curing the coating.

| Coating composition H | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Solution of Reference Example 6 | 11.5 parts |
| Phosphate ester surfactant (Phosphanol RD720, manufactured by Toho Chemical Industry Co., Ltd.) | 0.3 part |
| Talc (Microace P-3, manufactured by Nippon Talc Co., Ltd.) | 0.2 part |
| Methyl ethyl ketone | 33.0 parts |
| Toluene | 33.0 parts |

COMPARATIVE EXAMPLE 3

A comparative thermal transfer sheet was prepared in the same manner as in Example 1, except that, instead of the coating composition, for a heat-resistant slip layer, used in Example 1, the following coating composition I was coated and the resultant coating was dried and then heat-aged, thereby curing the coating.

| Coating composition I | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Dimethylpolysiloxane modified with polyoxyalkylene (SILWET L-7602, manufactured by Nippon Unicar Co., Ltd.) | 2.9 parts |
| Phosphate ester surfactant (Phosphanol RD720, manufactured by Toho Chemical Industry Co., Ltd.) | 0.3 part |
| Talc (Microace P-3, manufactured by Nippon Talc Co., Ltd.) | 0.2 part |
| Methyl ethyl ketone | 33.0 parts |
| Toluene | 33.0 parts |

COMPARATIVE EXAMPLE 4

A comparative thermal transfer sheet was prepared in the same manner as in Example 1, except that, instead of the coating composition, for a heat-resistant slip layer, used in Example 1, the following coating composition J was coated and the resultant coating was dried and then heat-aged, thereby curing the coating.

| Coating composition J | |
|---|---|
| Polyvinyl butyral resin (S-lec BX-1, manufactured by Sekisui Chemical Co., Ltd.) | 3.6 parts |
| Polyisocyanate (Burnock B-750-45, manufactured by Dainippon Ink and Chemicals, Inc.) | 19.2 parts |
| Stearyl alcohol | 2.9 parts |
| Phosphate ester surfactant (Phosphanol RD720, manufactured by Toho Chemical Industry Co., Ltd.) | 0.3 part |
| Talc (Microace P-3, manufactured by Nippon Talc Co., Ltd.) | 0.2 part |
| Methyl ethyl ketone | 33.0 parts |
| Toluene | 33.0 parts |

COMPARATIVE EXAMPLE 5

A comparative thermal transfer sheet was prepared in the same manner as in Example 1, except that, instead of the coating composition, for a heat-resistant slip layer, used in Example 1, the following coating composition K was coated and the resultant coating was dried and then heat-aged, thereby curing the coating.

| Coating composition K | |
|---|---|
| Polyvinyl butyral resin (S-lec BX-1, manufactured by Sekisui Chemical Co., Ltd.) | 3.6 parts |
| Polyisocyanate (Burnock D-750-45, manufactured by Dainippon Ink and Chemicals, Inc.) | 19.2 parts |
| Ester wax (Kao Wax 220, manufactured by Kao Corp.). | 2.9 parts |
| Phosphate ester surfactant (Phosphanol RD720, manufactured by Toho Chemical Industry Co., Ltd.) | 0.3 part |

-continued

| Coating composition K | |
|---|---|
| Talc (Microace P-3, manufactured by Nippon Talc Co., Ltd.) | 0.2 part |
| Methyl ethyl ketone | 33.0 parts |
| Toluene | 33.0 parts |

COMPARATIVE EXAMPLE 6

A comparative thermal transfer sheet was prepared in the same manner as in Comparative Example 1, except that the solution of Reference Example 11 was used instead of the solution of Reference Example 5.

COMPARATIVE EXAMPLE 7

A comparative thermal transfer sheet was prepared in the same manner as in Comparative Example 2, except that the solution of Reference Example 12 was used instead of the solution of Reference Example 6.

EVALUATION METHODS

1. Evaluation of sticking

Sheets in a small roll form were stored in an atmosphere of 40° C. for 48 hr, and 10 sheets of a step pattern with 8 gradations were continuously printed using a commercially available video printer and a pattern generator (CG-931, manufactured by Kenwood Corp.), which are likely to cause sticking to the thermal head, to determine the frequency of sticking [(number of sheets which caused sticking)/10 sheets]. The printing was carried out in an environment of 30° C. and 80% RH.

2. Evaluation of cockle in print.

Sheets in a small roll form were stored in an atmosphere of 40° C. for 48 hr, and pale color solid printing was carried out at 30° C. and 80% RH by means of a pattern generator (CG-931, manufactured by Kenwood Corp.) using a printer wherein the thermal head had been regulated so as to give an unsymmetrical pressure to facilitate the occurrence of cockle during printing.

○: No cockle during printing

Δ: Fine cockle during printing

X: Large cross-cockle during printing

3. Evaluation of collection of sheet debris on head 50 sheets of a step pattern with 8 gradations were continuously printed using a commercially available video printer and a pattern generator (CG-931, manufactured by Kenwood Corp.), and the surface of the thermal head at the heating section was then observed to examine the collection of sheet debris on the head.

○: Sheet debris not collected.

X: Sheet debris collected.

4. Contamination with dye

Sheets in a small roll form were stored in an atmosphere of 60° C. for 48 hr, and the contamination with a dye was then evaluated in terms of the extent of migration of dye to the heat-resistant slip layer.

○: Substantially no dye migrated.

Δ: Dye somewhat migrated

X: Dye significantly migrated.

The results are given in Table 1.

TABLE 1

| | Lubricant | | Evaluation results | | | |
|---|---|---|---|---|---|---|
| | Reaction product | Other lubricant | Sticking | Cockle in print | Collection of sheet debris on head | Contamination with dye |
| Ex. 1 | Ref. Ex. 1 | None | 0/10 | ○ | ○ | ○ |
| Ex. 2 | Ref. Ex. 1 | Used | 0/10 | ○ | ○ | ○ |
| Ex. 3 | Ref. Ex. 2 | Used | 0/10 | ○ | ○ | ○ |
| Ex. 4 | Ref. Ex. 3 | None | 0/10 | ○ | ○ | ○ |
| Ex. 5 | Ref. Ex. 4 | Used | 0/10 | ○ | ○ | Δ |
| Ex. 6 | Ref. Ex. 2<br>Ref. Ex. 3 | Used | 0/10 | ○ | ○ | ○ |
| Ex. 7 | Ref. Ex. 7 | None | 0/10 | ○ | ○ | ○ |
| Ex. 8 | Ref. Ex. 7 | Used | 0/10 | ○ | ○ | ○ |
| Ex. 9 | Ref. Ex. 8 | Used | 0/10 | ○ | ○ | ○ |
| Ex. 10 | Ref. Ex. 9 | None | 0/10 | ○ | ○ | ○ |
| Ex. 11 | Ref. Ex. 10 | Used | 0/10 | ○ | ○ | ○ |
| Ex. 12 | Ref. Ex. 8<br>Ref. Ex. 9 | Used | 0/10 | ○ | ○ | ○ |
| Comp. Ex. 1 | Ref. Ex. 5 | Used | 10/10 | X | X | ○ |
| Comp. Ex. 2 | Ref. Ex. 6 | Used | 10/10 | X | X | ○ |
| Comp. Ex. 3 | Dimethylpolysiloxane lubricant | | 7/10 | Δ | ○ | X |
| Comp. Ex. 4 | Stearyl alcohol | | 10/10 | X | X | X |
| Comp. Ex. 5 | Wax | | 0/10 | ○ | X | X |
| Comp. Ex. 6 | Ref. Ex. 11 | Used | 10/10 | X | X | ○ |
| Comp. Ex. 7 | Ref. Ex. 12 | Used | 10/10 | X | X | ○ |

Note)
Ex.: Example
Comp. Ex.: Comparative Example
Ref. Ex.: Reference Example

What is claimed is:

1. A thermal transfer sheet comprising: a substrate film; a heat-transferable colorant layer provided on one side of the substrate film; and a heat-resistant slip layer, provided on the other side of the substrate film, comprising a binder resin and a reaction product between a polyisocyanate and a straight-chain aliphatic hydrocarbon with 8 or more carbon atoms having, at its one end only, a group reactive with an isocyanate group.

2. The thermal transfer sheet according to claim 1, wherein the group reactive with the isocyanate group is selected from hydroxyl, amino, carboxyl, and mercapto groups.

3. The thermal transfer sheet according to claim 1, wherein the straight-chain aliphatic hydrocarbon is selected from a monovalent aliphatic saturated alcohol and an aliphatic primary amine.

4. The thermal transfer sheet according to claim 1, wherein the polyisocyanate is an aromatic polyisocyanate.

5. The thermal transfer sheet according to claim 1, wherein the content of the reaction product is 1 to 100 parts by weight based on 100 parts by weight of the binder resin.

6. The thermal transfer sheet according to claim 1, wherein the heat-resistant slip layer further comprises a higher fatty acid metal salt.

7. The thermal transfer sheet according to claim 6, wherein the higher fatty acid metal salt is selected from a lithium salt, magnesium salt, and calcium salt.

8. The thermal transfer sheet according to claim 6, wherein the content of the higher fatty acid metal salt is 20 to 80 parts by weight based on 100 parts by weight of the reaction product.

9. The thermal transfer sheet according to claim 1, wherein the heat-transferable colorant layer is selected from a sublimable colorant layer and a hot-melt ink layer.

10. The thermal transfer sheet according to claim 1, wherein the heat-resistant slip layer further comprises one of an organic filler and inorganic filler.

* * * * *